US010308064B2

(12) United States Patent
Kinnunen

(10) Patent No.: US 10,308,064 B2
(45) Date of Patent: Jun. 4, 2019

(54) PHOTOLUMINESCENT WRITING PAD AND NOTEPAD OR NOTEBOOK

(71) Applicant: Kalle Kinnunen, Hämeenlinna (FI)

(72) Inventor: Kalle Kinnunen, Hämeenlinna (FI)

( * ) Notice: Subject to any disclaimer, the term of this patent is extended or adjusted under 35 U.S.C. 154(b) by 0 days.

(21) Appl. No.: 15/545,792

(22) PCT Filed: Feb. 2, 2016

(86) PCT No.: PCT/FI2016/050066

§ 371 (c)(1),
(2) Date: Jul. 24, 2017

(87) PCT Pub. No.: WO2016/124820

PCT Pub. Date: Aug. 11, 2016

(65) Prior Publication Data

US 2018/0009255 A1 Jan. 11, 2018

(30) Foreign Application Priority Data

Feb. 4, 2015 (FI) ..... 20150037

(51) Int. Cl.

| | |
|---|---|
| ***B43L 3/00*** | (2006.01) |
| ***F21V 33/00*** | (2006.01) |
| ***B42D 5/00*** | (2006.01) |
| ***B42D 1/00*** | (2006.01) |
| ***B42B 5/12*** | (2006.01) |

(Continued)

(52) U.S. Cl.

CPC ..... *B43L 3/002* (2013.01); *B42B 5/12* (2013.01); *B42D 1/007* (2013.01); *B42D 1/008* (2013.01); *B42D 1/06* (2013.01); *B42D 5/007* (2013.01); *B43L 3/007* (2013.01); *B43L 3/008* (2013.01); *F21K 2/00* (2013.01); *F21V 33/0048* (2013.01)

(58) Field of Classification Search

None

See application file for complete search history.

(56) References Cited

U.S. PATENT DOCUMENTS

| | | | |
|---|---|---|---|
| 2,075,529 | A | 3/1937 | Leubrie |
| 2,879,609 | A | 3/1959 | Watkins |
| 3,978,340 | A | 8/1976 | Schroeder |

(Continued)

FOREIGN PATENT DOCUMENTS

| | | | |
|---|---|---|---|
| CN | 2126151 | U | 12/1992 |
| CN | 2710907 | Y | 7/2005 |

(Continued)

OTHER PUBLICATIONS

Apr. 21, 2016 International Search Report issued in International Patent Application No. PCT/FI2016/050066.

(Continued)

*Primary Examiner* — Ashok Patel
(74) *Attorney, Agent, or Firm* — Oliff PLC

(57) ABSTRACT

A photoluminescent writing pad, wherein a) the writing pad is fastened to a back cover of a notebook and arranged to be turned to a writing pad of a page of the notebook, b) the writing pad is arranged to gleam through a writing page thus enabling reading and writing in darkness and c) the writing pad has notches for accommodating a spiral wire, especially spiral or wire or similar binding, of a notebook for securing the writing pad under the page of the notebook to function as an interleaf.

8 Claims, 11 Drawing Sheets

(51) Int. Cl.
*F21K 2/00* (2006.01)
*B42D 1/06* (2006.01)

(56) References Cited

U.S. PATENT DOCUMENTS

| | | | | |
|---|---|---|---|---|
| 4,035,652 | A * | 7/1977 | Schroeder | F21K 2/00 250/462.1 |
| 5,041,326 | A | 8/1991 | Schroeder et al. | |
| 5,381,310 | A | 1/1995 | Brotz | |
| 5,915,873 | A * | 6/1999 | Karlis | B42D 5/006 281/38 |
| 2004/0197758 | A1 | 10/2004 | Langford | |
| 2006/0257200 | A1 * | 11/2006 | Busam | B42D 3/12 401/195 |
| 2007/0029777 | A1 * | 2/2007 | Williams | B42D 5/001 281/21.1 |
| 2012/0139227 | A1 * | 6/2012 | Busam | B42B 5/12 281/27 |
| 2013/0315651 | A1 | 11/2013 | Levinsohn | |
| 2015/0224806 | A1 * | 8/2015 | Good-Man | B42D 13/00 281/21.1 |

FOREIGN PATENT DOCUMENTS

| | | | |
|---|---|---|---|
| CN | 201080077 | Y | 7/2008 |
| CN | 201841824 | U | 5/2011 |
| CN | 201849067 | U | 6/2011 |
| CN | 201998596 | U | 10/2011 |
| CN | 202242580 | U | 5/2012 |
| CN | 202573363 | U | 12/2012 |
| DE | 328140 | C | 10/1920 |
| GB | 559603 | A | 2/1944 |

OTHER PUBLICATIONS

Jun. 3, 2015 Search Report issued in Finnish Patent Application No. 20150037.

Apr. 23, 2018 Office Action issued in Chinese Patent Application No. 201680008287.X.

Oct. 11, 2018 Extended European Search Report issued in European Patent Application No. 16746173.0.

* cited by examiner

PHOTOLUMINESCENT WRITING PAD AND NOTEPAD OR NOTEBOOK

FIELD OF THE INVENTION

The invention relates to a photoluminescent writing pad, particularly to be used with a notebook or similar. As an example, a notebook consisting of a photoluminescent sheet or sheets, paper sheets or stone paper sheets and covers, such as front cover and back cover, spirally bound together, and into at least one of which a photoluminescent writing pad is attachable and is made of e.g. plastic-based or aluminium-based material or a photoluminescent self-adhesive sheet on plastic or some other material.

BACKGROUND OF THE INVENTION

Especially from publication CN201998596 (U) is known a card book, which includes a protective pouch sealed from three surfaces, pages of the book and a photoluminescent plate. The card book is meant to be used for reading individual card pages and possibly for making notes. The solution does not offer a significant improvement especially in a purpose of making notes, because it's difficult to make notes to individual cards or sheets when the card is in the protective pouch.

Writing pads are also known from U.S. Pat. Nos. 3,978,340 and 5,381,310 and from US patent application 2013/0315651 and from GB patent 559,603.

BRIEF DESCRIPTION OF THE INVENTION

An object of the present invention, a photoluminescent writing pad, is to provide an improvement, especially to the above mentioned problems. It is characterizing for the writing pad according to the invention for implementing this object that is has features according to the characterizing part of claim 1. An advantage of the writing pad is especially emphasized when it is used in a notebook under a single writing sheet to emit light which allows writing in darkness. In addition, e.g. when used by the authorities, the writing pad prevents writing from creating a depression to underlying pages thus increasing security of information. It also makes e.g. a notebook more rigid and writing is easier.

In an advantageous embodiment lines or check pattern, image, photo, logo and/or text is printed to a part or whole area of the photoluminescent writing pad with silk printing or other suitable technology so that desired parts of any figures of the writing pad placed under a writing sheet can be seen.

The writing pad according to the invention offers a clear improvement especially in demanding conditions as it allows e.g. working in full darkness. The writing pad according to the invention is suitable for example conscripts, woodsmen, police, fire fighters, professional drivers and geocachers.

An advantageous embodiment is also that various clear or translucent writing materials, such as paper or plastic or similar can be used with the writing pad. Especially materials suitable for prevailing needs can be used, such as ordinary paper or water-resistant stone paper.

An advantageous embodiment is that the photoluminescent writing pad can be charged for example in car headlight or by using a flashlight. In a very advantageous embodiment green light of the photoluminescent writing pad does not blind night-vision devices or distract visibility.

Embodiments of the writing pad according to the invention are defined in the dependent claims.

BRIEF DESCRIPTION OF THE DRAWINGS

In the following the invention will be described in greater detail with reference to the accompanying drawings, in which.

DETAILED DESCRIPTION OF THE INVENTION

Figure 1:
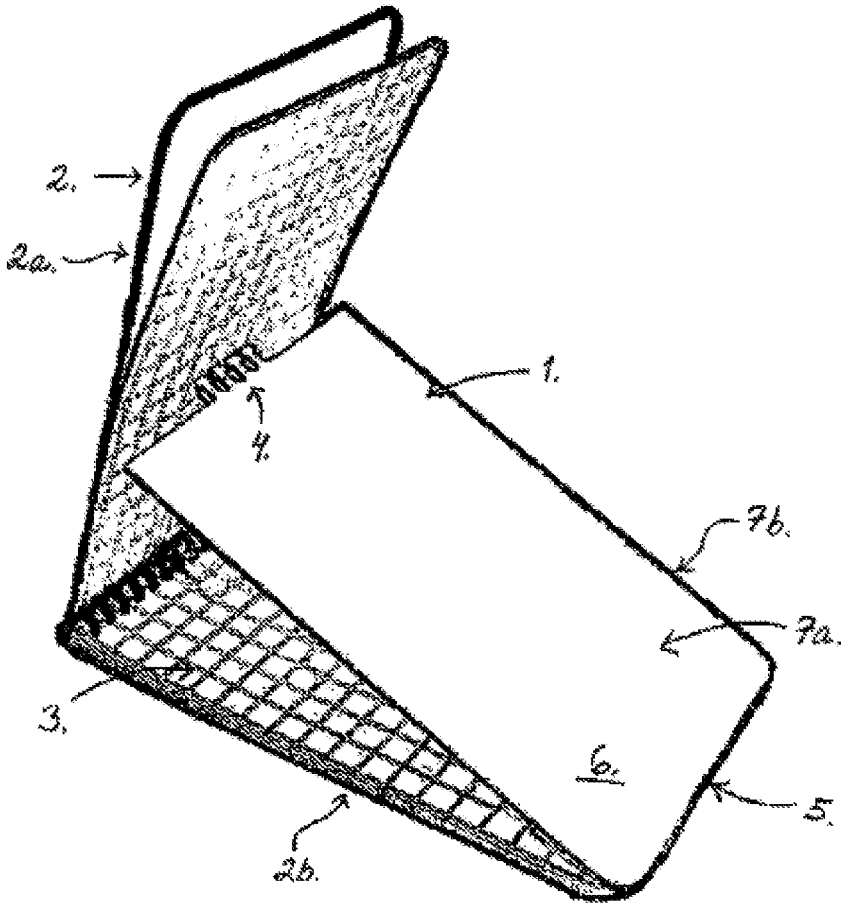
FIG. 1 illustrates a side-view to an advantageous embodiment for fastening a photoluminescent writing pad (1) to a spiral bound pocket notepad.
Figure 2:
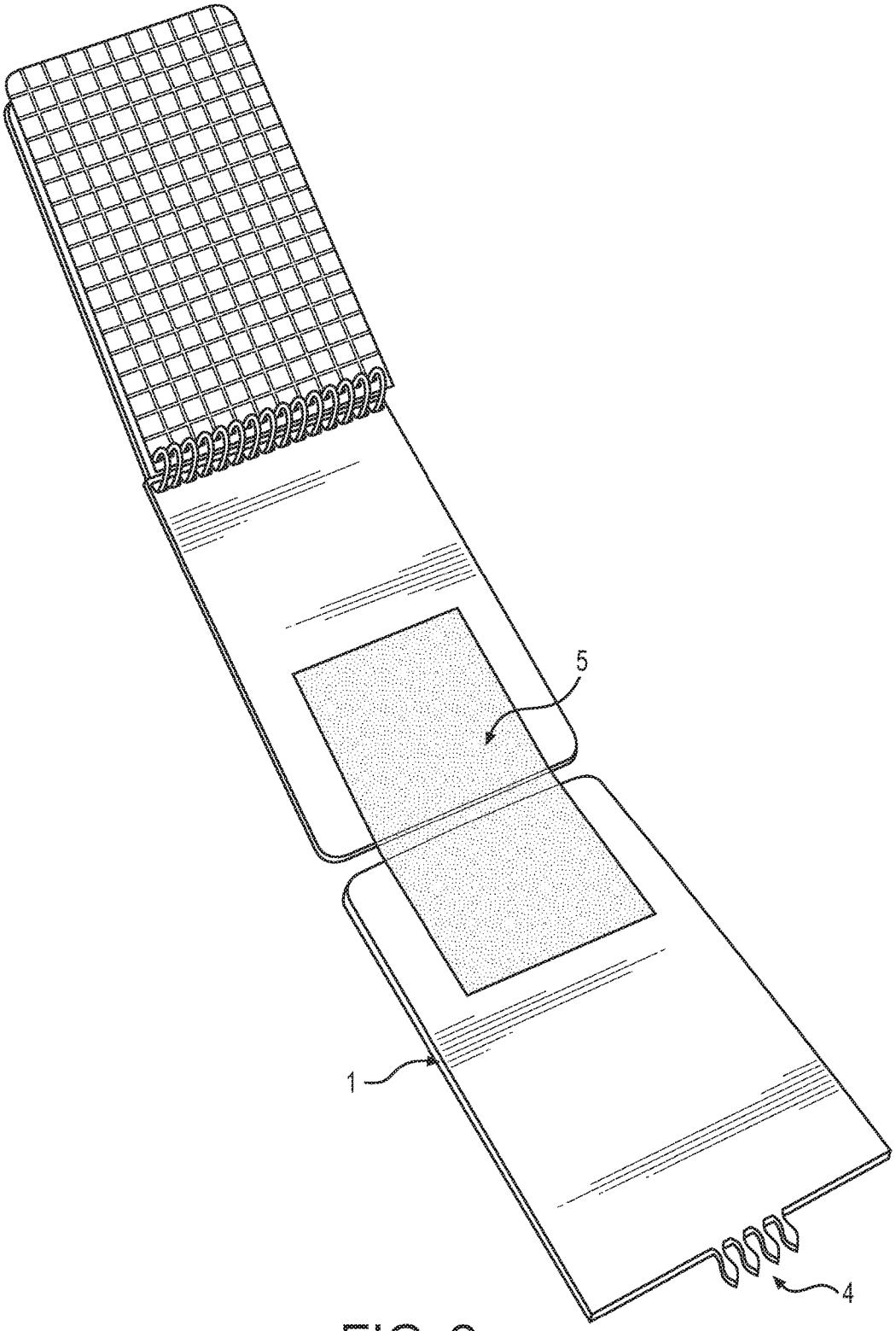
FIG. 2 illustrates the photoluminescent writing pad (1) of FIG. 1 when it's fastened to a back cover using a sticker (5), and having notches for securing (4) it to a spiral wire.
Figure 3:
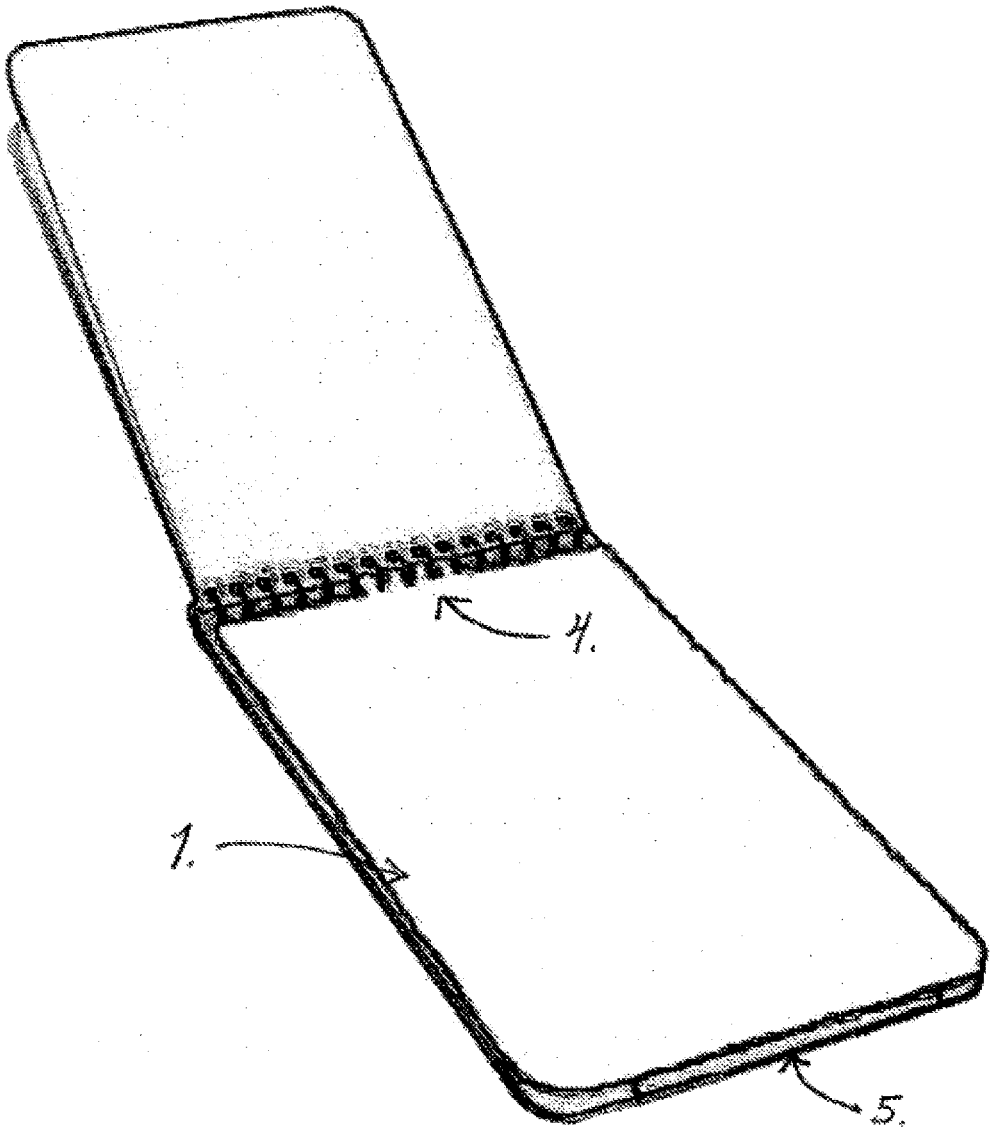
FIG. 3 illustrates the securing of the photoluminescent writing pad (1) of FIG. 1 to the spiral wire when it is also fastened to the back cover with a sticker (5)
Figure 4:
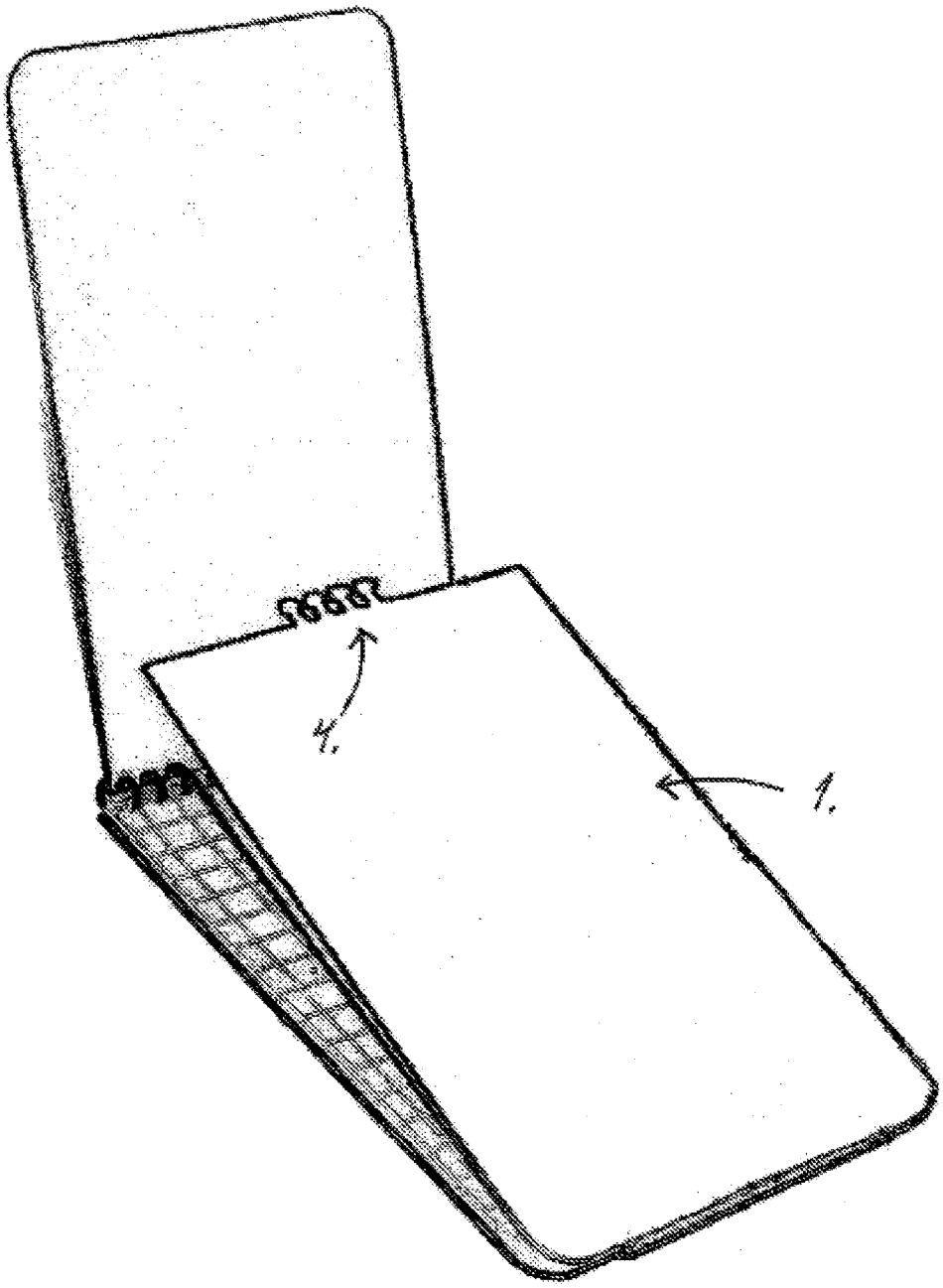
FIG. 4 illustrates releasing of the photoluminescent writing pad (1) of FIG. 1 from spiral by raising it, notches for securing (4) for placing it under writing sheet.
Figure 5:
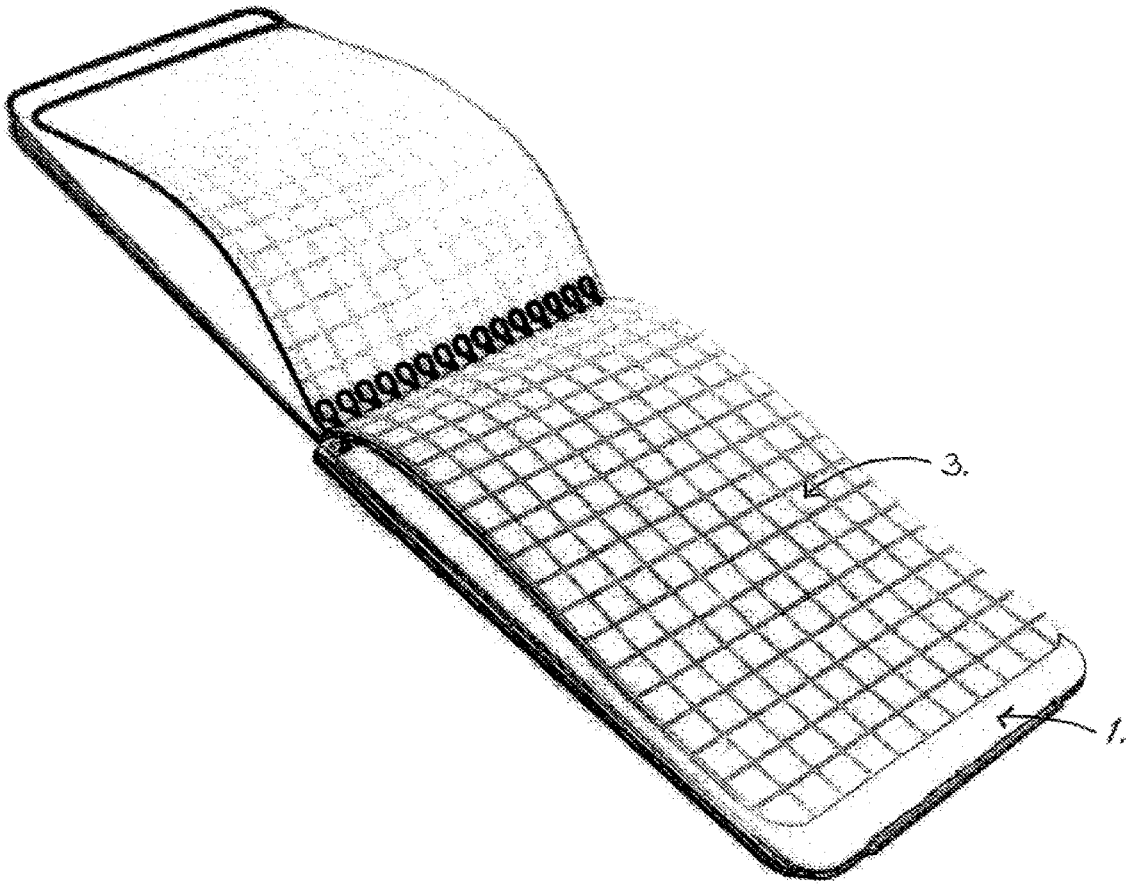
FIG. 5 illustrates the photoluminescent writing pad (1) of FIG. 1 placed under a writing page (3)
Figure 6:
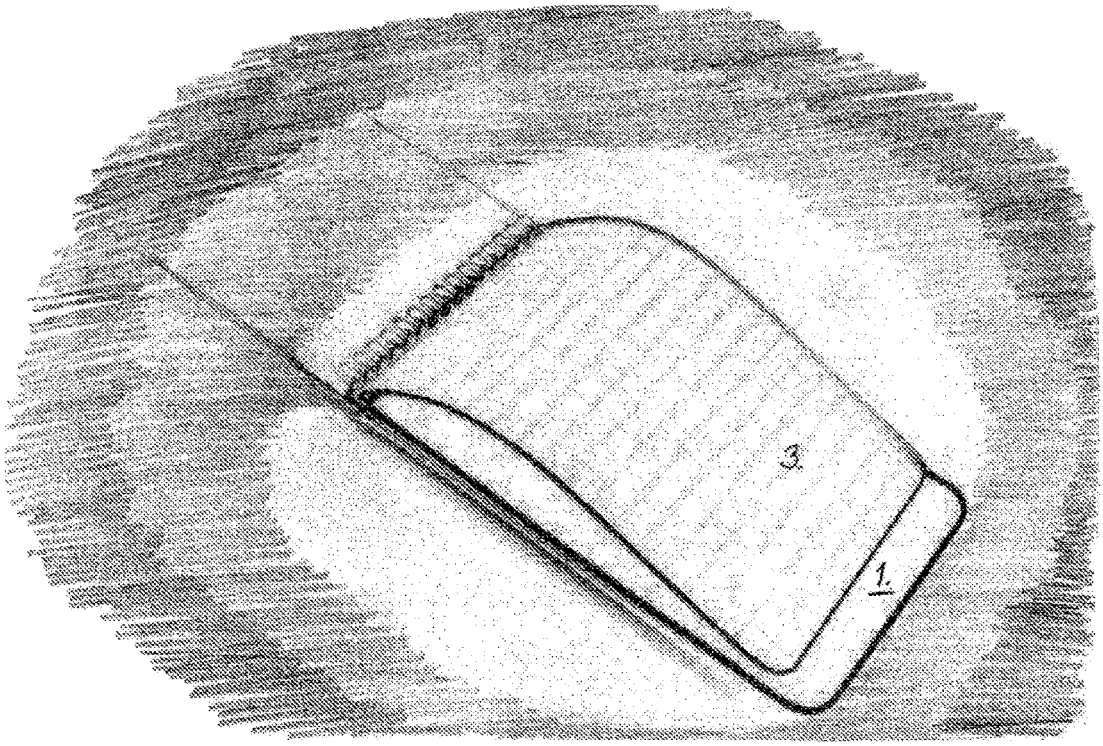
FIG. 6 illustrates light reflected by the photoluminescent writing pad (1) of FIG. 1 and reflection below the writing page (3) when the writing pad is placed below the writing page.
Figure 7:
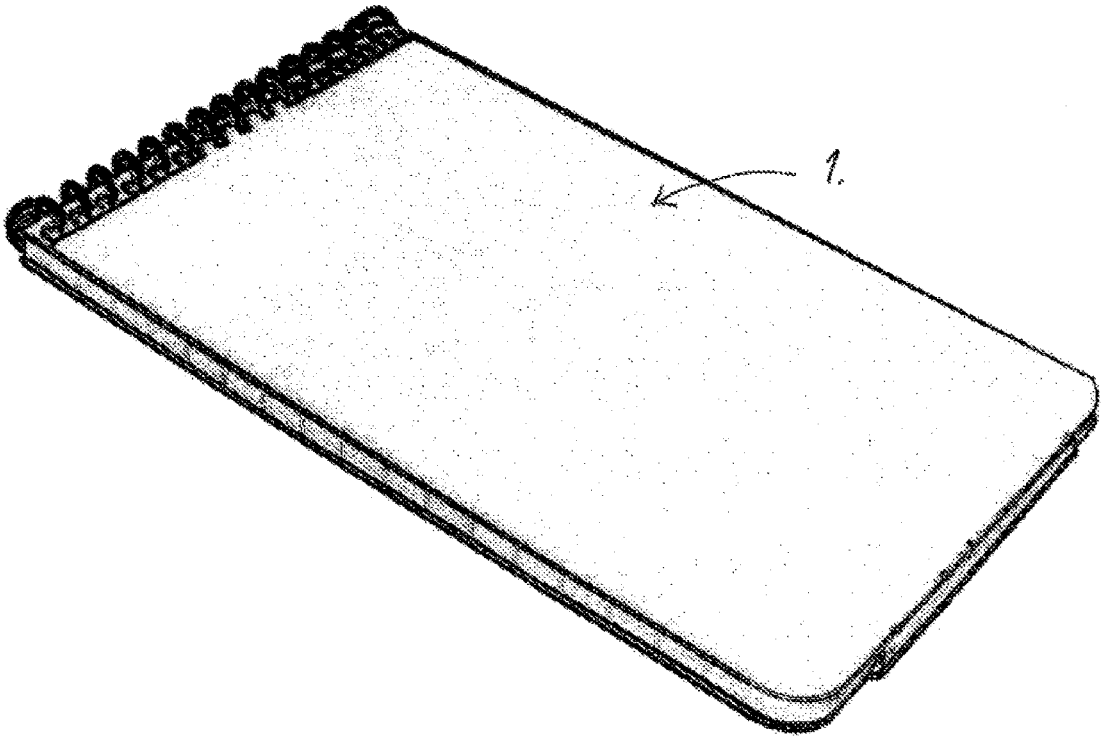
FIG. 7 illustrates use of the photoluminescent writing pad (1) of FIG. 1 on top of a spiral bound notepad for receiving light and is ready for use as soon as possible after moving to darkness.
Figure 8:
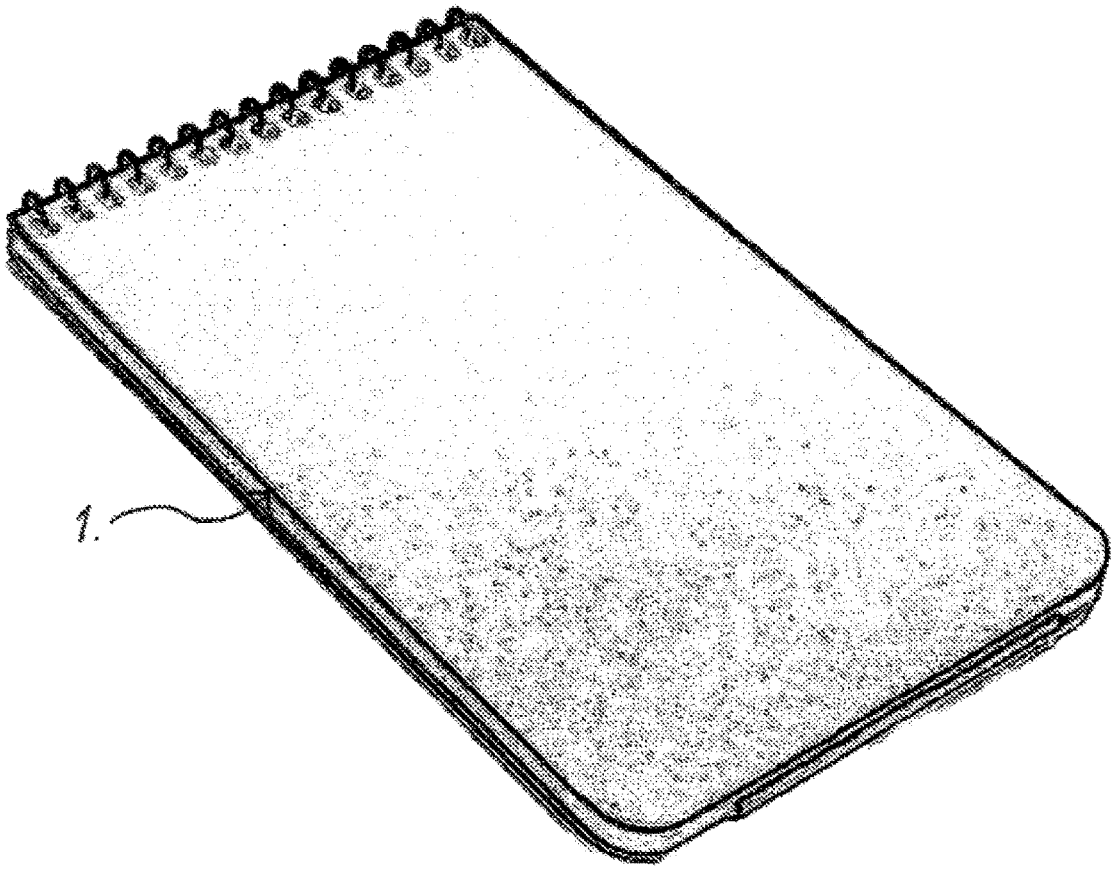
FIG. 8 illustrates storing of the photoluminescent writing pad (1) of FIG. 1 inside a spiral bound notepad.
Figure 9:
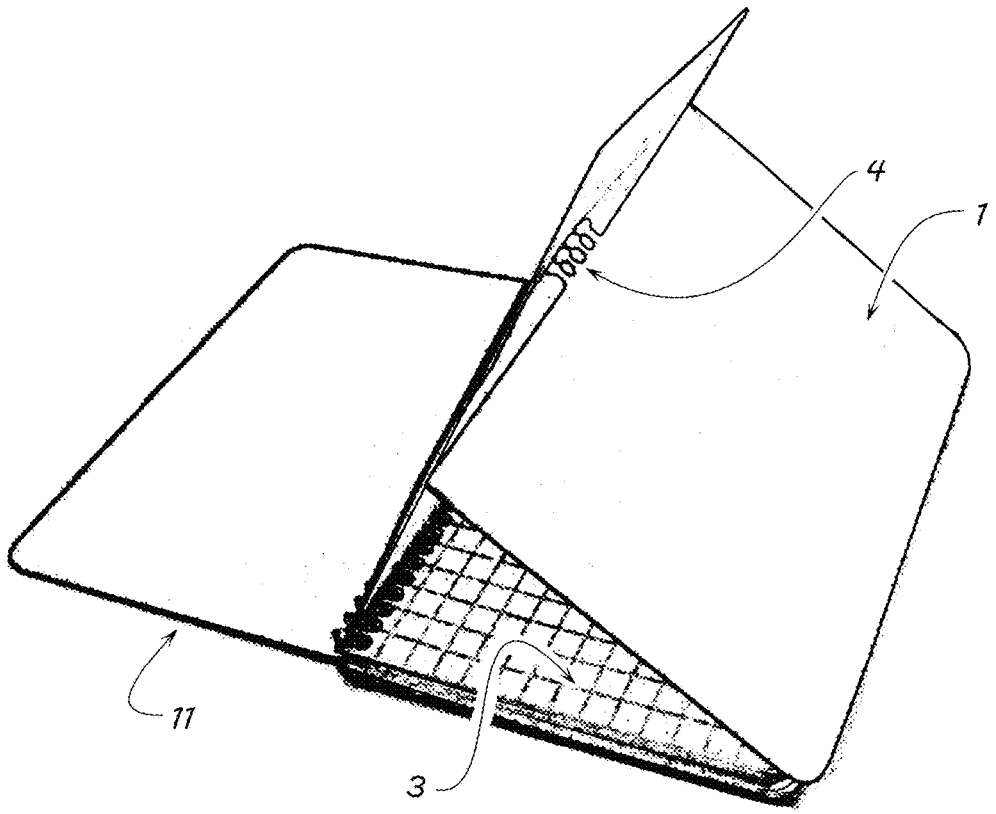
FIG. 9 illustrates a side-view to an embodiment for fastening a photoluminescent writing pad to a spiral bound notebook (11).
Figure 10:
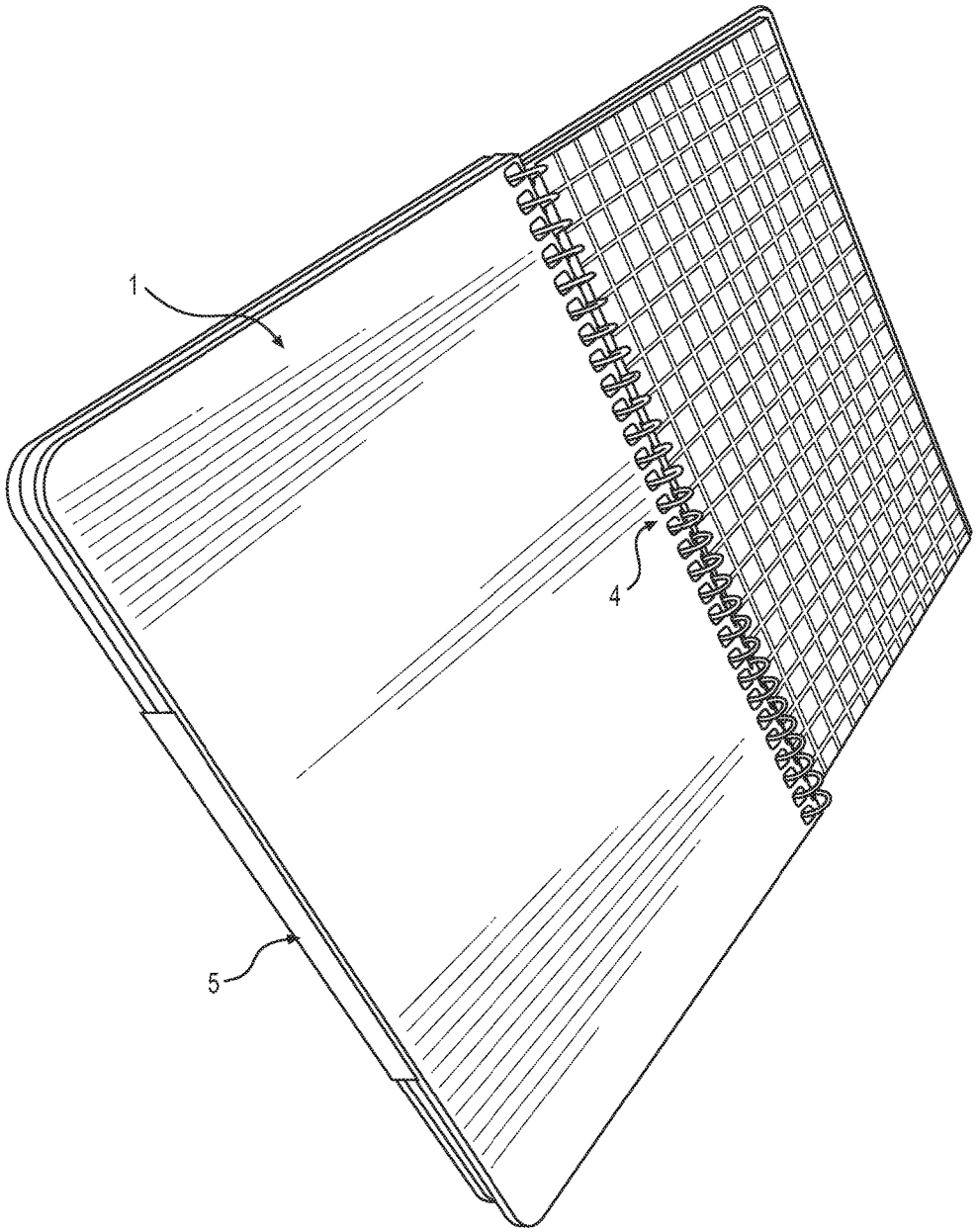
FIG. 10 illustrates the securing of the photoluminescent writing pad (1) of FIG. 9 to the spiral wire of the notebook (11) using notches (4) of the photoluminescent writing pad, the photoluminescent writing pad also being fastened to the back cover of the notebook with a sticker (5).
Figure 11:
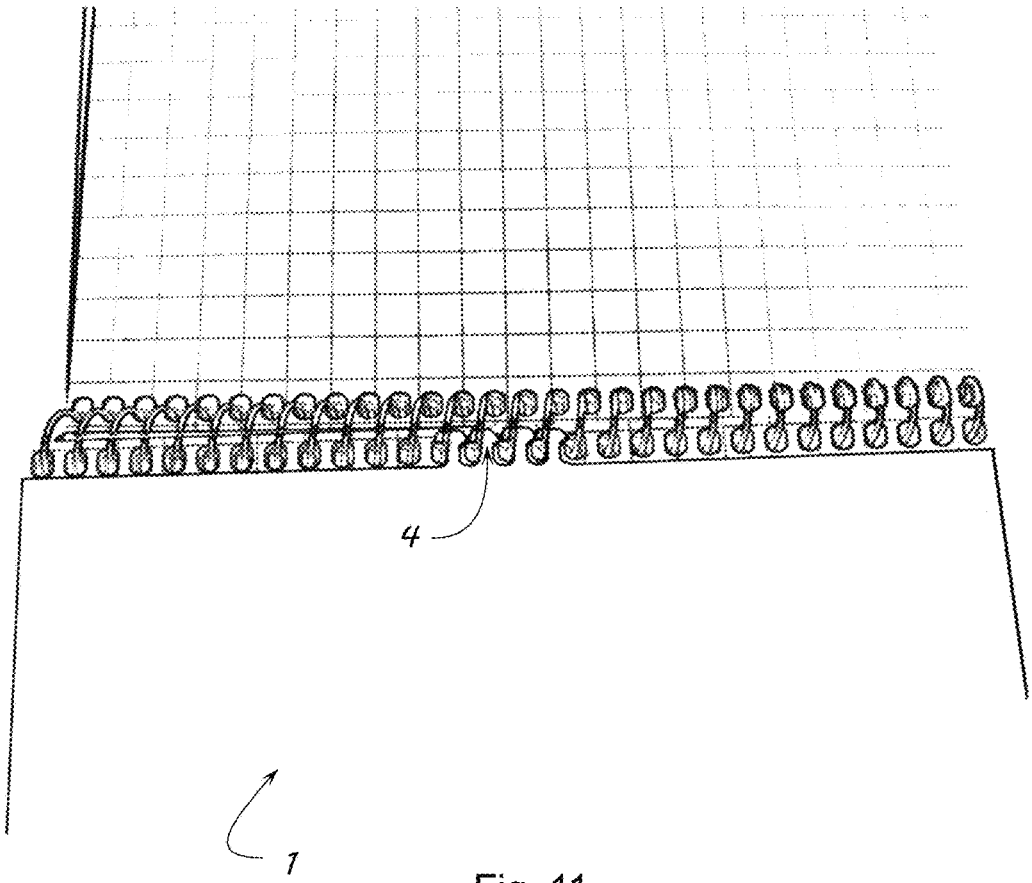
FIG. 11 illustrates the securing of the photoluminescent writing pad (1) of FIG. 9 to the spiral wire of the notebook (11) using notches (4) of the photoluminescent writing pad.

An advantageous embodiment especially for demanding conditions is a water-resistant writing pad with water-resistant covers and stone paper sheets which have been put together using e.g. spiral binding technique according to FIGS. 1 to 8. In a very advantageous embodiment the photoluminescent writing pad can be introduced under each separate page/sheet and secured to the spiral wire. The writing pad can also be fastened from various directions, for example upper edge, sides, lower edge or the writing pad can be unfastened. The writing pad can also be used as an interleaf.

In a very advantageous embodiment the writing pad enables reading and writing of necessary information of any given time.

In an advantageous embodiment of the photoluminescent writing pad according to the invention a spiral bound notepad is put together from one of the edges using e.g. spiral binding technique according to FIGS. 1 to 8, the writing pad is fastened to a back cover with a sticker 5 and it has notches 4 for securing it to the spiral wire.

Furthermore, an advantageous embodiment is use of the writing pad in a spiral bound notepad or notebook, wherein note sheets are water-resistant stone paper or similar water-resistant material.

Furthermore, an advantageous embodiment is suitability of the writing pad to demanding conditions.

An embodiment is a photoluminescent writing pad 1 that is fastened to a back cover 2*b*, opposite a front cover 2*a*, of a notebook or a spiral bound notepad 2 and arranged to be turned to a page 3 of the notebook or spiral bound notepad. The writing pad includes a front side 7*a* and a back side 7*b*, with surface 6 on a front side of the writing pad. When the writing pad 1 is arranged such that the surface 6 is under a writing page of the notebook or spiral bound notepad, the writing pad is able to gleam through the writing page thus enabling reading and writing in darkness. The writing pad 1 comprises notches 4 for accommodating a spiral wire, especially spiral or wire or similar binding, of a notebook or notepad for securing the writing pad 1 also from another end under the page of the notebook or spiral bound notepad to function as an interleaf.

In an embodiment the writing pad 1 comprises printed lines or check pattern covering a part or all of the writing pad.

In an embodiment note sheets of the photoluminescent writing pad are stone paper or similar water-resistant material. Note sheets can be pages that can be written onto.

It will be obvious to a person skilled in the art that embodiments are not limited to the examples described above but may vary within the scope of the claims. In this context material of the photoluminescent writing pad can be instead of e.g. coated plastic sheet other suitable materials, e.g. aluminium-based material. In this context also the notches for securing the writing pad can be altered if necessary.

The invention claimed is:

1. A photoluminescent writing pad, comprising a writing pad surface having a size substantially corresponding to a size of a page of a notebook or a notepad to which the writing pad surface is to be attached, one end of the writing pad surface including one or more notches capable of accommodating a binding of the notebook or the notepad so as to detachably secure the writing pad surface to the binding, wherein the writing pad is further capable of being fastened at another end to a back cover of the notebook or the notepad and of being arranged under a single page of the notebook or the notepad; and when the writing pad surface is secured to the binding and arranged under the single page of the notebook or the notepad, the writing pad surface is able to gleam through the single page of the notebook or the notepad to thereby enable reading and writing in darkness.

2. The photoluminescent writing pad of claim 1, wherein the writing pad surface is capable of being arranged under any single page of the notebook or the notepad.

3. The photoluminescent writing pad of claim 2, wherein the writing pad surface comprises printed lines or a check pattern covering a part or a whole of the writing pad surface.

4. The photoluminescent writing pad of claim 1, wherein the writing pad surface includes printed lines or a check pattern covering a part or a whole of the writing pad surface.

5. A spiral bound notepad or a spiral bound notebook comprising one or more pages and the photoluminescent writing pad of claim 1, wherein the photoluminescent writing pad is fastened to a back cover of the notepad or the notebook and wherein the one or more pages of the notepad or the notebook are comprised of stone paper or other water-resistant material.

6. The photoluminescent writing pad of claim 1, wherein the binding of the notebook or the notepad is a spiral wire.

7. A writing pad comprising a writing pad surface having a size substantially corresponding to a size of a page of a notebook or a notepad to which the writing pad surface is to be attached, one end of the writing pad surface including notches capable of accommodating a binding of the notebook or the notepad so as to detachably secure the writing pad surface to the binding, wherein the writing pad surface is configured to be fastened from another end thereof to a back cover of a notebook or a notepad and to be turned to be arranged under a single writing page of the notebook or the notepad; and the writing pad surface is photoluminescent and configured to emit light through said single writing page so as to enable reading thereof and writing thereon in darkness.

8. The photoluminescent writing pad of claim 7, wherein the binding comprises a spiral wire.

* * * * *